United States Patent [19]

Gaylor

[11] Patent Number: 4,492,049

[45] Date of Patent: Jan. 8, 1985

[54] ADVERTISING DISPLAY STRUCTURE AND SPORTS FACILITY

[76] Inventor: Marcia Gaylor, Suite 5706 300 N. State St., Chicago, Ill. 60610

[21] Appl. No.: 544,586

[22] Filed: Oct. 24, 1983

[51] Int. Cl.[3] ..... G09F 15/00

[52] U.S. Cl. ..... 40/624; 40/557; 40/606; 40/611; 273/1.5 R

[58] Field of Search ..... 40/624, 606, 607, 611, 40/557, 598, 612; 273/1.5 R, 368; 362/253, 249

[56] References Cited

U.S. PATENT DOCUMENTS

| | | | |
|---|---|---|---|
| 1,847,775 | 3/1932 | Manfre | 40/557 |
| 3,488,875 | 1/1970 | Gant | 40/607 |
| 3,626,896 | 12/1971 | Preeshl | 40/612 |
| 3,842,524 | 10/1974 | Drueck, Jr. | 40/607 |
| 4,266,763 | 5/1981 | Collins | 273/368 |

FOREIGN PATENT DOCUMENTS

| | | | |
|---|---|---|---|
| 1106052 | 12/1955 | France | 40/607 |
| 538788 | 1/1956 | Italy | 40/624 |
| 1006504 | 10/1965 | United Kingdom | 273/1.5 R |

OTHER PUBLICATIONS

"The Fun Wagon" article in The Evening Star, 8-6-68.

*Primary Examiner*—John J. Wilson

*Attorney, Agent, or Firm*—McWilliams, Mann Zummer & Sweeny

[57] ABSTRACT

The combination of an advertising display structure and a sporting facility in which a vertical support is anchored into the ground and supports a basketball hoop and backboard intermediate its ends and a billboard display at its upper end. The billboard includes display panels and a lighting arrangement positioned underneath a walkway with downwardly directed lighting fixtures arranged so as to illuminate the basketball play area beneath the billboard including the hoop and backboard.

7 Claims, 6 Drawing Figures

10
11
12
13
14
16
18
19
22
22A
23
24
24A
26
27

FIG. 4
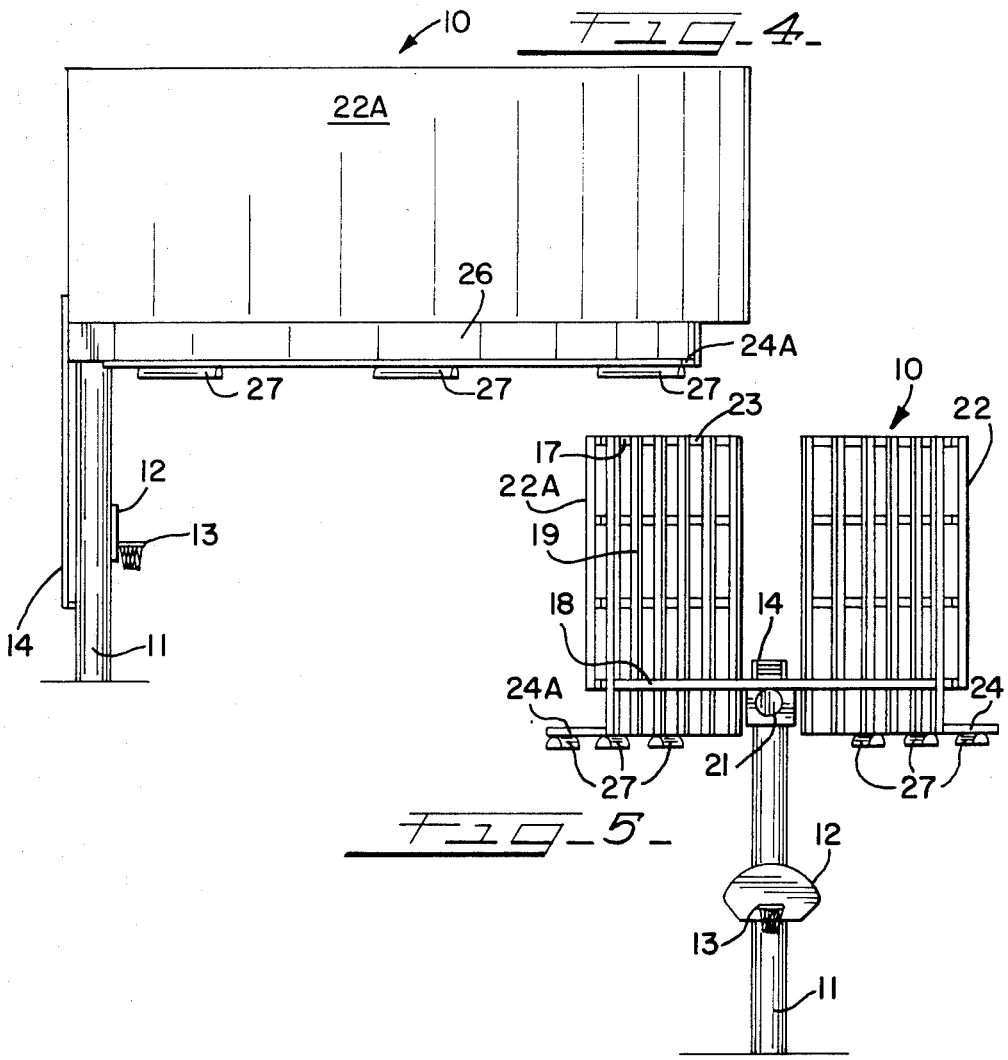
FIG. 5
FIG. 6
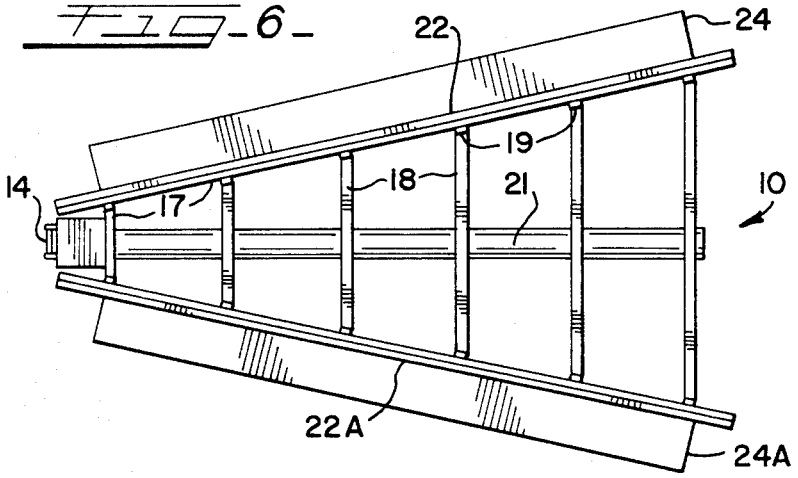

ADVERTISING DISPLAY STRUCTURE AND SPORTS FACILITY

BACKGROUND OF THE INVENTION

Numerous approaches have been made to the design and structure of advertising billboards and the illumination thereof. A variety of arrangements have also been provided for sporting facilities such as basketball courts including lighting and hoop and backboard supports. Each of these fields have developed separately with no thought or suggestion of combining the features of each into an integral unit.

Typical of structural supports for signs and billboards are the arrangements shown in Manfre U.S. Pat. No. 1,847,775, Dunne U.S. Pat. No. 3,564,783, Preeshl U.S. Pat. No. 3,626,896, Neely U.S. Pat. No. 4,141,056, Perretta U.S. Pat. No. 4,270,161, and Lathrop U.S. Pat. No. 4,299,043.

A variety of approaches to hoop games are the arrangements shown in Seligson U.S. Des. Pat. No. 199,908, Van Tassel U.S. Pat. No. 3,802,703, and Collins U.S. Pat. Nos. 4,202,543, and 4,266,763.

SUMMARY OF THE INVENTION

Recently it has been determined that it would be of great benefit to provide the combination of an advertising display structure or billboard with a sporting facility which includes a lighting arrangement to illuminate the area underneath the billboard. Such an arrangement would allow the development of municipally-owned vacant parcels of land into useful recreational facilities in otherwise blighted neighborhoods. The recreational facilities could then be donated to the municipality in exchange for long-term leases for outdoor advertising. The net result of such an arrangement is to place unused, publicly owned property in disadvantaged neighborhoods into useful recreational areas available to the public at no cost to the municipality.

Unfortunately, prior to the present arrangement, no device existed which combined all of the features of the present invention to provide a unitary structure which functions as both an advertising display and an illuminated sporting facility.

The present invention consists of a vertical support extending from the ground carrying a backboard and hoop at an appropriate height and supporting an advertising display at its upper end. The billboard includes one or more message display panels, preferably arranged back to back, and a lighting arrangement positioned on the underside of a walkway associated with the lower end of the display panels. The lighting fixtures are downwardly directed so as to illuminate the sporting area below the billboard including the hoop and backboard.

DESCRIPTION OF THE DRAWINGS

FIG. 4 is a side view as seen from the right side of FIG. 1.

FIG. 5 is a front view of the apparatus shown in FIG. 1.

FIG. 6 is a top plan view of the apparatus shown in FIG. 1.

DESCRIPTION OF THE PREFERRED EMBODIMENT

Figures 1, 2, 3:
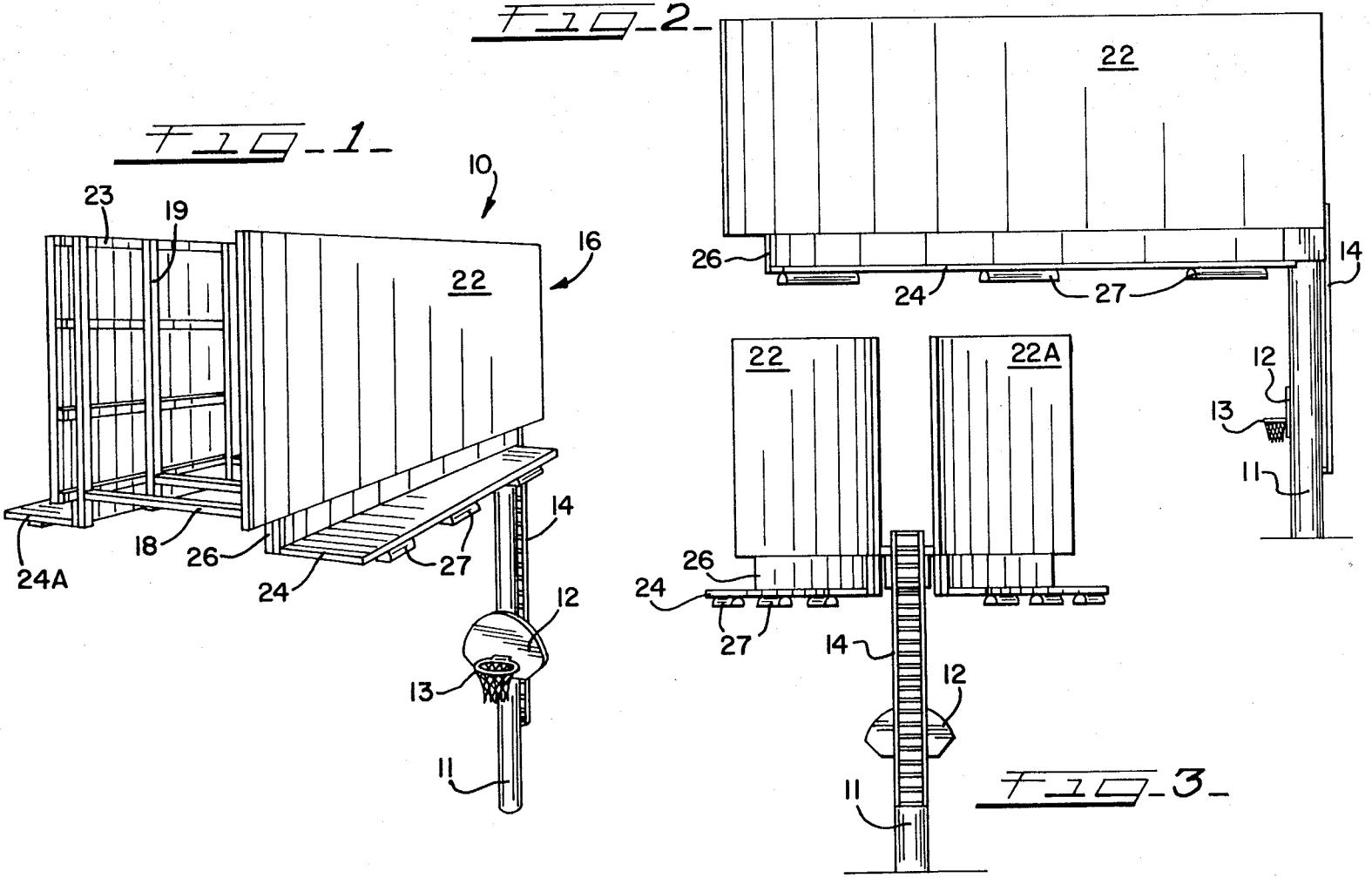
FIG. 1 is a perspective view showing the combination billboard and sporting facility of the present invention installed in an improved lot.
FIG. 2 is a side view as seen from the left side of FIG. 1.
FIG. 3 is a rear view of the apparatus shown in FIG. 1.

In FIG. 1 there is illustrated a combination advertising display structure and sporting facility identified generally with the numeral 10. The apparatus includes a vertically-extending support member 11 extending upwardly from the ground. The support 11 may be cemented into the ground or secured thereto by any of a number of well-known arrangements. Carried by the pole 11, intermediate its ends, is a sporting facility illustrated as a basketball backboard 12 and a hoop 13 extending from the backboard. The hoop and backboard may be affixed to the pole 11 by any of a number of suitable, permanent fastening mechanisms such as, for example, by welding, or may be releasably mounted by a fastening arrangement consisting of bolts, nuts, and brackets which are not shown. The backboard and hoop 12, 13 are positioned on the front face of the pole 11, as shown in FIG. 1 facing an open playing surface. Attached to the rear face of the pole 11 is a ladder 14, the purpose of which will be discussed later.

Disposed at the top of the pole 11 and connected thereto is an advertising display structure 16 sometimes referred to as a billboard. The display structure consists of a frame 17 which is secured to the pole 11. The frame 17 consists of a plurality of horizontally disposed struts 18 which engage a plurality of vertical struts 19. The frame may also include a horizontally-extending central supporting strut 21.

One or more advertising or message display panels 22 are secured to and supported by the frame 17. The preferred embodiment includes a pair of display panels 22 and **22*a* arranged in a generally back-to-back relationship, as shown in FIG. 6, and disposed at an acute angle to each other. Although the embodiment illustrated in the drawings shows the panels 22 and 22*a* angularly disposed with respect to each other, it is within the purview of the present invention to arrange these panels parallel to each other in adjacent proximity or spaced apart at some predetermined distance. Another alternative embodiment of the present arrangement, now shown, is a rectangular arrangement of message display panels carried by the frame 17 and supported by the pole 11. Additionally, it should be pointed out that the drawings illustrate an arrangement whereby the frame 17 and message display panels are connected to a support member 11 disposed at one side of the frame. This arrangement is referred to in the trade as a "flag built" structure. Other embodiments of the present invention include arrangements in which the support member 11** is located intermediate the ends of the display panels as, for example, having the pole centrally mounted with respect to the frame.

As illustrated in FIG. 1, the message display panels 22 and **22*a* may include supporting braces 23 disposed on the back face thereof. Associated with each message display panel is a horizontal platform 24 which is connected to the display panel or frame through flange 26. The platform 24 extends outwardly from the flange 26** a sufficient distance so as to provide a walkway parallel to the display panel to enable workmen to easily change the message being displayed.

Positioned underneath the platform 24 are a plurality of lighting fixtures 27 which are directed downwardly so as to illuminate the sporting area underneath the advertising display including the backboard 12, the hoop 13, and the ground playing surface adjacent thereto. The illumination means 27 can be operated by a switch, not shown, disposed on the pole or can be pre-set to be activated and deactivated at predetermined times. Alternatively, the lighting apparatus can be energized by a light-sensitive mechanism so as to be turned on and off depending upon natural lighting conditions.

The operation of the present invention is believed to be self-explanatory from the drawings and the descriptive portion of the specification immediately preceding. The present invention provides a unique combination of elements which function together to provide recreation, illumination, and a means for generating revenue. The increased illumination of previously abandoned or deserted municipally-owned lots enhances neighborhood security while at the same time providing a recreational facility at no cost to the community or the users. The advertising display structure is arranged so that when workmen need access to the display panels for changing of the advertising material, they need only climb the ladder 14 to gain access to the walkways 24 and 24*a*. The lighting fixtures 27 are serviceable from the platform 24. Additional illuminating means can be provided for the message display panels 22 and 22*a* so as to light the panels themselves. Such additional lighting fixtures could be disposed, for example, on the upper surface of the walkways 24.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. The combination of an advertising display structure and a sporting facility, the combination including a vertically-extending support member adapted to engage the ground at one end and to provide a support for both a basketball hoop and backboard and an advertising display, a basketball hoop and backboard affixed to said vertical support intermediate its ground-engaging end and its upper end, an advertising display structure affixed to and supported by the upper end of said vertical support consisting of a frame and one or more message display panels carried by said frame, and illuminating means carried by said frame arranged so as to direct light downwardly from said advertising display structure and to illuminate the area below said display structure including said hoop and backboard.

2. The combination of an advertising display structure and a sporting facility as in claim 1 including a pair of advertising display panels arranged in a generally back-to-back relationship.

3. The combination of an advertising display structure and a sporting facility as in claim 2 in which said display panels are parallel to each other.

4. The combination of an advertising display structure and a sporting facility as in claim 2 in which said display panels are disposed at an angle with respect to each other.

5. The combination of an advertising display structure and a sporting facility as in claim 1 in which said frame structure supports a horizontal platform disposed adjacent the lower end of said display panel so as to provide a walkway parallel to said display panel.

6. The combination of an advertising display structure and a sporting facility as in claim 5 in which said illuminating means consist of a plurality of downwardly directed light fixtures disposed beneath said horizontal platform.

7. The combination of an advertising display structure and a sporting facility as in claim 1 including a ladder attached to said vertical pole on a side opposite said hoop and backboard so as to facilitate access from the ground to said display panels.

* * * * *